US009407012B2

(12) United States Patent
Shtrom et al.

(10) Patent No.: US 9,407,012 B2
(45) Date of Patent: Aug. 2, 2016

(54) ANTENNA WITH DUAL POLARIZATION AND MOUNTABLE ANTENNA ELEMENTS

(75) Inventors: Victor Shtrom, Los Altos, CA (US); Bernard Baron, Mountain View, CA (US)

(73) Assignee: RUCKUS WIRELESS, INC., Sunnyvale, CA (US)

( * ) Notice: Subject to any disclaimer, the term of this patent is extended or adjusted under 35 U.S.C. 154(b) by 220 days.

(21) Appl. No.: 12/887,448

(22) Filed: Sep. 21, 2010

(65) Prior Publication Data

US 2012/0068892 A1 Mar. 22, 2012

(51) Int. Cl.

| | |
|---|---|
| ***H01Q 1/38*** | (2006.01) |
| ***H01Q 21/24*** | (2006.01) |
| ***H01Q 9/26*** | (2006.01) |
| ***H01Q 19/22*** | (2006.01) |
| ***H01Q 21/20*** | (2006.01) |

(52) U.S. Cl.

CPC ..... *H01Q 21/24* (2013.01); *H01Q 9/26* (2013.01); *H01Q 19/22* (2013.01); *H01Q 21/205* (2013.01)

(58) Field of Classification Search

USPC ..... 343/702, 700 MS

See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld et al. |
| 3,577,196 | A | 5/1971 | Pereda |
| 3,846,799 | A | 11/1974 | Gueguen |
| 3,918,059 | A | 11/1975 | Adrian |
| 3,922,685 | A | 11/1975 | Opas |
| 3,967,067 | A | 6/1976 | Potter |
| 3,982,214 | A | 9/1976 | Burns |
| 3,991,273 | A | 11/1976 | Mathes |
| 4,001,734 | A | 1/1977 | Burns |

(Continued)

FOREIGN PATENT DOCUMENTS

| | | | |
|---|---|---|---|
| CN | 1210839 | C | 7/2005 |
| CN | 1 934 750 | A | 3/2007 |

(Continued)

OTHER PUBLICATIONS

PCT/US07/09278, PCT Search Report and Written Opinion mailed Aug. 18, 2008.

(Continued)

*Primary Examiner* — Hoang V Nguyen
*Assistant Examiner* — Hai Tran
(74) *Attorney, Agent, or Firm* — Lewis Roca Rothgerber Christie LLP

(57) ABSTRACT

A wireless device having a mountable antenna element and an antenna array that operate simultaneously and efficiently on a circuit board within a wireless device. The mountable antenna element may be coupled to a ground layer of the circuit board. The antenna array may include dipole antennas incorporated within the circuit board and positioned within a close proximity to the ground layer. One or more stubs may be implemented on the circuit board near the dipole antenna array. Each antenna stub may create an impedance in the dipole elements which enable the antenna elements to operate efficiently while positioned in close proximity to the circuit board ground layer.

20 Claims, 8 Drawing Sheets

(56) References Cited

U.S. PATENT DOCUMENTS 4,145,693 A 3/1979 Fenwick
4,176,356 A 11/1979 Foster et al.
4,193,077 A 3/1980 Greenberg et al.
4,253,193 A 2/1981 Kennard
4,305,052 A 12/1981 Baril et al.
4,513,412 A 4/1985 Cox
4,554,554 A 11/1985 Olesen et al.
4,733,203 A 3/1988 Ayasli
4,814,777 A 3/1989 Monser
4,845,507 A 7/1989 Archer et al.
4,975,711 A 12/1990 Lee
5,063,574 A 11/1991 Moose
5,097,484 A 3/1992 Akaiwa
5,132,698 A 7/1992 Swineford
5,173,711 A 12/1992 Takeuchi et al.
5,203,010 A 4/1993 Felix
5,208,564 A 5/1993 Burns et al.
5,220,340 A 6/1993 Shafai
5,282,222 A 1/1994 Fattouche et al.
5,291,289 A 3/1994 Hulyalkar et al.
5,311,550 A 5/1994 Fouche et al.
5,373,548 A 12/1994 McCarthy
5,507,035 A 4/1996 Bantz
5,532,708 A 7/1996 Krenz et al.
5,559,800 A 9/1996 Mousseau et al.
5,610,617 A 3/1997 Gans et al.
5,629,713 A 5/1997 Mailandt et al.
5,754,145 A 5/1998 Evans
5,767,755 A 6/1998 Kim et al.
5,767,809 A 6/1998 Chuang et al.
5,786,793 A 7/1998 Maeda et al.
5,802,312 A 9/1998 Lazaridis et al.
5,964,830 A 10/1999 Durrett
5,990,838 A 11/1999 Burns et al.
6,006,075 A 12/1999 Smith et al.
6,011,450 A 1/2000 Miya
6,018,644 A 1/2000 Minarik
6,031,503 A 2/2000 Preiss, II et al.
6,034,638 A 3/2000 Thiel et al.
6,052,093 A 4/2000 Yao et al.
6,091,364 A 7/2000 Murakami et al.
6,094,177 A 7/2000 Yamamoto
6,097,347 A 8/2000 Duan et al.
6,101,397 A 8/2000 Grob et al.
6,104,356 A 8/2000 Hikuma et al.
6,166,694 A * 12/2000 Ying ..... H01Q 1/243 343/700 MS
6,169,523 B1 1/2001 Ploussios
6,239,762 B1 5/2001 Lier
6,252,559 B1 6/2001 Donn
6,266,528 B1 7/2001 Farzaneh
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,337,628 B2 1/2002 Campana et al.
6,337,668 B1 1/2002 Ito et al.
6,339,404 B1 1/2002 Johnson et al.
6,345,043 B1 2/2002 Hsu
6,356,242 B1 3/2002 Ploussios
6,356,243 B1 3/2002 Schneider et al.
6,356,905 B1 3/2002 Gershman et al.
6,377,227 B1 4/2002 Zhu et al.
6,392,610 B1 5/2002 Braun et al.
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skidmore et al.
6,445,688 B1 9/2002 Garces et al.
6,452,556 B1 9/2002 Ha et al.
6,452,981 B1 9/2002 Raleigh
6,456,242 B1 9/2002 Crawford
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,531,985 B1 3/2003 Jones et al.
6,583,765 B1 6/2003 Schamberger et al.
6,586,786 B2 7/2003 Tanaka et al.
6,606,059 B1 8/2003 Barabash
6,611,230 B2 8/2003 Phelan
6,621,464 B1 9/2003 Fang
6,625,454 B1 9/2003 Rappaport et al.
6,633,206 B1 10/2003 Kato
6,642,889 B1 11/2003 McGrath
6,674,459 B2 1/2004 Ben-Shachar et al.
6,701,522 B1 3/2004 Rubin et al.
6,720,925 B2 4/2004 Wong et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,753,826 B2 6/2004 Chiang et al.
6,762,723 B2 7/2004 Nallo et al.
6,774,846 B2 8/2004 Fullerton et al.
6,779,004 B1 8/2004 Zintel
6,801,790 B2 10/2004 Rudrapatna
6,819,287 B2 11/2004 Sullivan et al.
6,839,038 B2 1/2005 Weinstein
6,859,176 B2 2/2005 Choi
6,859,182 B2 2/2005 Horii
6,876,280 B2 4/2005 Nakano
6,876,836 B2 4/2005 Lin et al.
6,888,504 B2 5/2005 Chiang et al.
6,888,893 B2 5/2005 Li et al.
6,892,230 B1 5/2005 Gu et al.
6,903,686 B2 6/2005 Vance et al.
6,906,678 B2 6/2005 Chen
6,910,068 B2 6/2005 Zintel et al.
6,914,581 B1 7/2005 Popek
6,924,768 B2 8/2005 Wu et al.
6,931,429 B2 8/2005 Gouge et al.
6,937,206 B2 8/2005 Puente Ballarda et al.
6,941,143 B2 9/2005 Mathur
6,943,749 B2 9/2005 Paun
6,950,019 B2 9/2005 Bellone et al.
6,950,069 B2 9/2005 Gaucher et al.
6,961,026 B2 11/2005 Toda
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,034,769 B2 4/2006 Surducan et al.
7,034,770 B2 4/2006 Yang et al.
7,039,363 B1 5/2006 Kasapi et al.
7,043,277 B1 5/2006 Pfister
7,050,809 B2 5/2006 Lim
7,053,844 B2 5/2006 Gaucher et al.
7,053,845 B1 * 5/2006 Holloway et al. ..... 343/725
7,064,717 B2 6/2006 Kaluzni et al.
7,068,234 B2 6/2006 Sievenpiper
7,075,485 B2 7/2006 Song et al.
7,084,816 B2 8/2006 Watanabe
7,084,823 B2 8/2006 Caimi et al.
7,085,814 B1 8/2006 Gandhi et al.
7,088,299 B2 8/2006 Siegler et al.
7,089,307 B2 8/2006 Zintel et al.
7,130,895 B2 10/2006 Zintel et al.
7,171,475 B2 1/2007 Weisman et al.
7,193,562 B2 * 3/2007 Shtrom ..... H01Q 1/38 343/700 MS
7,196,674 B2 * 3/2007 Timofeev ..... H01Q 1/245 343/700 MS
7,277,063 B2 10/2007 Shirosaka et al.
7,308,047 B2 12/2007 Sadowsky
7,312,762 B2 12/2007 Puente Ballards et al.
7,319,432 B2 1/2008 Andersson

(56) References Cited

U.S. PATENT DOCUMENTS

| | | | | |
|---|---|---|---|---|
| 7,362,280 | B2 | 4/2008 | Shtrom et al. | |
| 7,388,552 | B2 | 6/2008 | Mori | |
| 7,424,298 | B2 | 9/2008 | Lastinger et al. | |
| 7,493,143 | B2 | 2/2009 | Jalali | |
| 7,498,996 | B2 | 3/2009 | Shtrom et al. | |
| 7,525,486 | B2 | 4/2009 | Shtrom et al. | |
| 7,603,141 | B2 | 10/2009 | Dravida | |
| 7,609,223 | B2 | 10/2009 | Manasson et al. | |
| 7,646,343 | B2 | 1/2010 | Shtrom et al. | |
| 7,652,632 | B2 | 1/2010 | Shtrom et al. | |
| 7,675,474 | B2 | 3/2010 | Shtrom et al. | |
| 7,696,940 | B1 | 4/2010 | Macdonald | |
| 7,696,943 | B2 | 4/2010 | Chiang et al. | |
| 7,696,948 | B2 | 4/2010 | Abramov et al. | |
| 7,868,842 | B2 | 1/2011 | Chair | |
| 7,880,683 | B2 | 2/2011 | Shtrom et al. | |
| 7,899,497 | B2 | 3/2011 | Kish et al. | |
| 7,965,252 | B2 | 6/2011 | Shtrom et al. | |
| 8,031,129 | B2 | 10/2011 | Shtrom et al. | |
| 8,199,063 | B2 | 6/2012 | Moon et al. | |
| 8,314,749 | B2 | 11/2012 | Shtrom et al. | |
| 8,698,675 | B2 | 4/2014 | Shtrom et al. | |
| 8,860,629 | B2 | 10/2014 | Shtrom et al. | |
| 2001/0046848 | A1 | 11/2001 | Kenkel | |
| 2002/0031130 | A1 | 3/2002 | Tsuchiya et al. | |
| 2002/0047800 | A1 | 4/2002 | Proctor, Jr. et al. | |
| 2002/0054580 | A1 | 5/2002 | Strich et al. | |
| 2002/0080767 | A1 | 6/2002 | Lee | |
| 2002/0084942 | A1 | 7/2002 | Tsai et al. | |
| 2002/0101377 | A1 | 8/2002 | Crawford | |
| 2002/0105471 | A1 | 8/2002 | Kojima et al. | |
| 2002/0112058 | A1 | 8/2002 | Weisman et al. | |
| 2002/0140607 | A1* | 10/2002 | Zhou | H01Q 1/243 343/700 MS |
| 2002/0158798 | A1 | 10/2002 | Chiang et al. | |
| 2002/0170064 | A1 | 11/2002 | Monroe et al. | |
| 2003/0026240 | A1 | 2/2003 | Eyuboglu et al. | |
| 2003/0030588 | A1 | 2/2003 | Kalis et al. | |
| 2003/0063591 | A1 | 4/2003 | Leung et al. | |
| 2003/0122714 | A1 | 7/2003 | Wannagot et al. | |
| 2003/0169330 | A1 | 9/2003 | Ben-Shachar et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017315 | A1 | 1/2004 | Fang et al. | |
| 2004/0017860 | A1 | 1/2004 | Liu | |
| 2004/0027291 | A1 | 2/2004 | Zhang et al. | |
| 2004/0027304 | A1 | 2/2004 | Chiang et al. | |
| 2004/0032378 | A1 | 2/2004 | Volman et al. | |
| 2004/0036651 | A1 | 2/2004 | Toda | |
| 2004/0036654 | A1 | 2/2004 | Hsieh | |
| 2004/0041732 | A1 | 3/2004 | Aikawa et al. | |
| 2004/0048593 | A1 | 3/2004 | Sano | |
| 2004/0058690 | A1 | 3/2004 | Ratzel et al. | |
| 2004/0061653 | A1 | 4/2004 | Webb et al. | |
| 2004/0070543 | A1 | 4/2004 | Masaki | |
| 2004/0075609 | A1 | 4/2004 | Li | |
| 2004/0080455 | A1 | 4/2004 | Lee | |
| 2004/0095278 | A1 | 5/2004 | Kanemoto et al. | |
| 2004/0114535 | A1 | 6/2004 | Hoffmann et al. | |
| 2004/0125777 | A1 | 7/2004 | Doyle et al. | |
| 2004/0145528 | A1 | 7/2004 | Mukai et al. | |
| 2004/0160376 | A1 | 8/2004 | Hornsby et al. | |
| 2004/0183727 | A1 | 9/2004 | Choi | |
| 2004/0190477 | A1 | 9/2004 | Olson et al. | |
| 2004/0203347 | A1 | 10/2004 | Nguyen | |
| 2004/0239571 | A1 | 12/2004 | Papziner et al. | |
| 2004/0260800 | A1 | 12/2004 | Gu et al. | |
| 2005/0001777 | A1* | 1/2005 | Suganthan | H01Q 5/371 343/795 |
| 2005/0022210 | A1 | 1/2005 | Zintel et al. | |
| 2005/0041739 | A1 | 2/2005 | Li et al. | |
| 2005/0042988 | A1 | 2/2005 | Hoek et al. | |
| 2005/0048934 | A1 | 3/2005 | Rawnick et al. | |
| 2005/0074018 | A1 | 4/2005 | Zintel et al. | |
| 2005/0097503 | A1 | 5/2005 | Zintel et al. | |
| 2005/0105632 | A1 | 5/2005 | Catreux-Erces et al. | |
| 2005/0128983 | A1 | 6/2005 | Kim et al. | |
| 2005/0135480 | A1 | 6/2005 | Li et al. | |
| 2005/0138137 | A1 | 6/2005 | Encarnacion et al. | |
| 2005/0138193 | A1 | 6/2005 | Encarnacion et al. | |
| 2005/0146475 | A1 | 7/2005 | Bettner et al. | |
| 2005/0180381 | A1 | 8/2005 | Retzer et al. | |
| 2005/0188193 | A1 | 8/2005 | Kuehnel et al. | |
| 2005/0200529 | A1 | 9/2005 | Watanabe | |
| 2005/0219128 | A1 | 10/2005 | Tan et al. | |
| 2005/0240665 | A1 | 10/2005 | Gu et al. | |
| 2005/0266902 | A1 | 12/2005 | Khatri | |
| 2005/0267935 | A1 | 12/2005 | Gandhi et al. | |
| 2006/0007891 | A1 | 1/2006 | Aoki et al. | |
| 2006/0038734 | A1 | 2/2006 | Shtrom et al. | |
| 2006/0050005 | A1 | 3/2006 | Shirosaka et al. | |
| 2006/0078066 | A1 | 4/2006 | Yun | |
| 2006/0094371 | A1 | 5/2006 | Nguyen | |
| 2006/0098607 | A1 | 5/2006 | Zeng et al. | |
| 2006/0109191 | A1 | 5/2006 | Shtrom et al. | |
| 2006/0123124 | A1 | 6/2006 | Weisman et al. | |
| 2006/0123125 | A1 | 6/2006 | Weisman et al. | |
| 2006/0123455 | A1 | 6/2006 | Pai et al. | |
| 2006/0160495 | A1 | 7/2006 | Strong | |
| 2006/0168159 | A1 | 7/2006 | Weisman et al. | |
| 2006/0184660 | A1 | 8/2006 | Rao et al. | |
| 2006/0184661 | A1 | 8/2006 | Weisman et al. | |
| 2006/0184693 | A1 | 8/2006 | Rao et al. | |
| 2006/0187660 | A1 | 8/2006 | Liu | |
| 2006/0224690 | A1 | 10/2006 | Falkenburg et al. | |
| 2006/0225107 | A1 | 10/2006 | Seetharaman et al. | |
| 2006/0227761 | A1 | 10/2006 | Scott, III et al. | |
| 2006/0239369 | A1 | 10/2006 | Lee | |
| 2006/0262015 | A1 | 11/2006 | Thornell-Pers et al. | |
| 2006/0291434 | A1 | 12/2006 | Gu et al. | |
| 2007/0027622 | A1 | 2/2007 | Cleron et al. | |
| 2007/0135167 | A1 | 6/2007 | Liu | |
| 2007/0162819 | A1 | 7/2007 | Kawamoto | |
| 2008/0266189 | A1 | 10/2008 | Wu et al. | |
| 2008/0284657 | A1 | 11/2008 | Rudant | |
| 2009/0075606 | A1 | 3/2009 | Shtrom et al. | |
| 2010/0289705 | A1 | 11/2010 | Shtrom et al. | |
| 2011/0205137 | A1 | 8/2011 | Shtrom et al. | |
| 2012/0007790 | A1 | 1/2012 | Shtrom et al. | |
| 2013/0181882 | A1 | 7/2013 | Shtrom et al. | |
| 2014/0071013 | A1 | 3/2014 | Shtrom et al. | |
| 2014/0225807 | A1 | 8/2014 | Shtrom et al. | |
| 2014/0285391 | A1 | 9/2014 | Baron | |

FOREIGN PATENT DOCUMENTS

| | | | |
|---|---|---|---|
| CN | 102868024 | A | 1/2013 |
| CN | 103201908 | A | 7/2013 |
| CN | ZL 200780020943.9 | | 11/2013 |
| CN | 101473488 | B | 2/2014 |
| EP | 352787 | A2 | 1/1990 |
| EP | 0 534 612 | | 3/1993 |
| EP | 0756381 | A2 | 1/1997 |
| EP | 1 152 452 | | 11/2001 |
| EP | 1152543 | A1 | 11/2001 |
| EP | 1 376 920 | | 6/2002 |
| EP | 1220461 | A2 | 7/2002 |
| EP | 1 315 311 | | 5/2003 |
| EP | 1 450 521 | | 8/2004 |
| EP | 1 562 259 | A1 | 8/2005 |
| EP | 1 608 108 | | 12/2005 |
| EP | 1 152 453 | | 11/2011 |
| EP | 2 479 837 | | 7/2012 |
| EP | 2 619 848 | | 7/2013 |
| EP | 2 893 593 | | 7/2015 |
| HK | 1180836 | A | 10/2013 |
| JP | 03038933 | | 2/1991 |
| JP | 2008/088633 | | 2/1996 |

(56) References Cited

FOREIGN PATENT DOCUMENTS

| | | | |
|---|---|---|---|
| JP | 2011-215040 | | 8/1999 |
| JP | 2001/057560 | | 2/2002 |
| JP | 2005/354249 | | 12/2005 |
| JP | 2006/060408 | | 3/2006 |
| TW | I372487 | | 9/2012 |
| TW | I451624 | | 9/2014 |
| WO | WO 90/04893 | | 5/1990 |
| WO | WO 02/25967 | | 3/2002 |
| WO | WO 03/079484 | | 9/2003 |
| WO | WO2006023247 | A1 | 3/2006 |
| WO | WO 2007/127087 | | 11/2007 |
| WO | WO 2007/127088 | | 11/2007 |
| WO | WO 2012/040397 | | 3/2012 |
| WO | WO 2014/039949 | | 3/2014 |
| WO | WO 2014/146038 | | 9/2014 |

OTHER PUBLICATIONS

PCT/US11/052661, PCT Search Report and Written Opinion mailed Jan. 17, 2012.
Chinese patent application No. 200780023325.X, First Office Action mailed Feb. 13, 2012.
U.S. Appl. No. 11/413,670, Final Office Action mailed Jul. 13, 2009.
U.S. Appl. No. 11/413,670, Office Action mailed Jan. 6, 2009.
U.S. Appl. No. 11/413,670, Final Office Action mailed Aug. 11, 2008.
U.S. Appl. No. 11/413,670, Office Action mailed Feb. 4, 2008.
U.S. Appl. No. 11/414,117, Final Office Action mailed Jul. 6, 2009.
U.S. Appl. No. 11/414,117, Office Action mailed Sep. 25, 2008.
U.S. Appl. No. 11/414,117, Office Action mailed Mar. 21, 2008.
U.S. Appl. No. 12/605,256, Office Action mailed Dec. 28, 2010.
U.S. Appl. No. 13/240,687, Office Action mailed Feb. 22, 2012.
U.S. Appl. No. 12/545,758, Final Office Action mailed Oct. 3, 2012.
U.S. Appl. No. 12/545,758, Office Action mailed Oct. 3, 2012.
Ando et al., "Study of Dual-Polarized Omni-Directional Antennas for 5.2 GHz-Band 2x2 MIMO-OFDM Systems," Antennas and Propagation Society International Symposium, 2004, IEEE, pp. 1740-1743, vol. 2.
Bedell, Paul, "Wireless Crash Course," 2005, p. 84, The McGraw-Hill Companies, Inc., USA.
Petition Decision Denying Request to Order Additional Claims for U.S. Pat. No. 7,193,562 (Control No. 95/001078) mailed on Jul. 10, 2009.
Right of Appeal Notice for U.S. Pat. No. 7,193,562 (Control No. 95/001078) mailed on Jul. 10, 2009.
Chuang et al., "A 2.4 GHz Polarization-diversity Planar Printed Diopoe Antenna for Wlan and Wireless Communication Applications," Microwave Journal, vol. 45, No. 6, pp. 50-62, Jun. 2002.
Frederick et al., Smart Antennas Based on Spatial Multiplexing of Local Elements (SMILE) for Mutual Coupling Reduction, IEEE Transactions of Antennas and Propagation, vol. 52, No. 1, pp. 106-114, Jan. 2004.
W. E. Doherty, Jr. et al., "The Pin Diode Circuit Designer's Handbook," 1998.
Varnes et al., "A Switched Radial Divider for an L-Band Mobile Satellite Antenna," European Microwave Conference, Oct. 1995, pp. 1037-1041.
English Translation of PCT Pub. No. WO2004/051798 (as filed National Stage U.S. Appl. No. 10/536,547).
Behdad et al., "Slot Antenna Miniaturization Using Distributed Inductive Loading," Antenna and Propagation Society International Symposium, 2003 IEEE, vol. 1, pp. 308-311, Jun. 2003.
Press Release, "NETGEAR RangeMax(TM) Wireless Solutions Incorporate Smart MIMO Technology to Eliminate Wireless Dead Spots and Take Consumers Farther," Ruckus Wireless, Inc., Mar. 7, 2005. Available at: http://ruckuswireless.com/press/releases/20050307.php.
"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.
"Authorization of spread spectrum and other wideband emissions not presently provided for in the FCC Rules and.Regulations," Before the Federal Communications Commission, FCC 81-289, 87 F.C.C.2d 876, Jun. 30, 1981.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Chang, Robert W., "Synthesis of Band-Limited Orthogonal Signals for Multichannel Data Transmission," The Bell System Technical Journal, Dec. 1966, pp. 1775-1796.
Cimini, Jr., Leonard J., "Analysis and Simulation of a Digital Mobile Channel Using Orthogonal Frequency Division Multiplexing," IEEE Transactions on Communications, vol. Com-33, No. 7, Jul. 1985, pp. 665-675.
Saltzberg, Burton R., "Performance of an Efficient Parallel Data Transmission System," IEEE Transactions on Communication Technology, vol. Com-15, No. 6., Dec. 1967, pp. 805-811.
Weinstein, S.B., et al., "Data Transmission by Frequency-Division Multiplexing Using Discrete Fourier Transform," IEEE Transactions on Communication Technology, vol. Com-19, No. 5, Oct. 1971, pp. 628-634.
Moose, Paul H., "Differential Modulation and Demodulation of Multi-Frequency Digital Communications Signals," 1990 IEEE, CH2831-6/90/0000-0273.
Casas, Eduardo F., et al., "OFDM for Data Communication Over Mobile Radio FM Channels-Part I: Analysis and Experimental Results," IEEE Transactions on Communications, vol. 39, No. 5., May 1991, pp. 783-793.
Casas, Eduardo F., et al., "OFDM for Data Communication Over Mobile Radio FM Channels-Part Ii: Performance Improvement," Department of Electrical Engineering, University of British Columbia, 1992.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Alard, M., et al., "Principles of Modulation and Channel Coding for Digital Broadcasting for Mobile Receivers," 8301 EBU Review Technical, Aug. 1987, No. 224, Brussels, Belgium.
Berenguer, Inaki, et al., "Adaptive MIMO Antenna Selection," Nov. 2003.
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Sadek, Mirette, et al., "Active Antenna Selection in Multiuser MIMO Communications," IEEE Transactions on Signal Processing, vol. 55, No. 4, Apr. 2007, pp. 1498-1510.
Molisch, Andreas F., et al., "MIMO Systems with Antenna Selection-an Overview," Draft, Dec. 31, 2003.
Tang, Ken, et al., "MAC Layer Broadcast Support in 802.11 Wireless Networks," Computer Science Department, University of California, Los Angeles, 2000 IEEE, pp. 544-548.
Tang, Ken, et al., "MAC Reliable Broadcast in Ad Hoc Networks," Computer Science Department, University of California, Los Angeles, 2001 IEEE, pp. 1008-1013.
Park, Vincent D., et al., "A Performance Comparison of the Temporally-Ordered Routing Algorithm and Ideal Link-State Routing," IEEE, Jul. 1998, pp. 592-598.
Akyildiz, Ian F., et al., "A Virtual Topology Based Routing Protocol for Multihop Dynamic Wireless Networks," Broadband and Wireless Networking Lab, School of Electrical and Computer Engineering, Georgia Institute of Technology, 2001.
Dell Inc., "How Much Broadcast and Multicast Traffic Should I Allow in my Network," PowerConnect Application Note #5, Nov. 2003.
Toskala, Antti, "Enhancement of Broadcast and Introduction of Multicast Capabilities in RAN," Nokia Networks, Palm Springs, California, Mar. 13-16, 2001.

(56) References Cited

OTHER PUBLICATIONS

Microsoft Corporation, "IEEE 802.11 Networks and Windows XP," Windows Hardware Developer Central, Dec. 4, 2001.
Festag, Andreas, "What is MOMBASA?" Telecommunication Networks Group (TKN), Technical University of Berlin, Mar. 7, 2002.
Hewlett Packard, "HP ProCurve Networking: Enterprise Wireless LAN Networking and Mobility Solutions," 2003.
Dutta, Ashutosh, et al., "MarconiNet Supporting Streaming Media Over Localized Wireless Multicast," Proc. of the 2d Int'l Workshop on Mobile Commerce, 2002.
Dunkels, Adam, et al., "Making TCP/IP Viable for Wireless Sensor Networks," Proc. of the 1st Euro. Workshop on Wireless Sensor Networks, Berlin, Jan. 2004.
Dunkels, Adam, et al., "Connecting Wireless Sensornets with TCP/IP Networks," Proc. of the 2nd Int'l Conf. on Wired Networks, Frankfurt, Feb. 2004.
Cisco Systems, "Cisco Aironet Access Point Software Configuration Guide: Configuring Filters and Quality of Service," Aug. 2003.
Hirayama, Koji, et al., "Next Generation Mobile-Access IP Network" Hitachi Review, vol. 49, No. 4, 2000.
Calhoun, Pat, et al., "802.11r strengthens wireless voice," Technology Update, Network World, Aug. 22, 2005. http://www.networkworld.com/news/tech/2005/082208techupdate.html.
Alimian, Areg, et al., "Analysis of Roaming Techniques," doc.:IEEE 802.11-04/0377r1, Submission, Mar. 2004.
Information Society Technologies Ultrawaves, "System Concept / Architecture Design and Communcation Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias, et al., "Transmit Antenna Diversity in Ricean Fading MIMO Channels with Co-Channel Interference," 2001.
Steger, Christopher, et al., "Performance of IEEE 802.11b Wireless LAN in an Emulated Mobile Channel, " 2003.
Chang, Nicholas B., et al., "Optimal Channel Probing and Transmission Scheduling for Opportunistics Spectrum Access" Sep. 2007.
Tsunekawa, Kouichi, "Diversity Antennas for Portable Telephones," 39th IEEE Vehicular Technology Conference, pp. 50-56, vol. 1, Gateway to New Concepts in Vehicular Technology, May 1-3, 1989, San Francisco, CA.
Supplementary European Search Report for foreign application No. EP07755519 dated Mar. 11, 2009.
U.S. Appl. No. 12/545,758, Office Action mailed Jan. 2, 2013.
Chinese Patent Application No. 201210330398.6, First Office Action mailed Feb. 20, 2014.
European Application No. 11827493.5 Extended European Search Report dated Nov. 6, 2014, 2014.
Chinese Patent Application No. 201210330398.6, Second Office Action mailed Sep. 24, 2014, 2014.
Chinese Patent Application No. 201180050872.3, First Office Action mailed May 30, 2014.
PCT/US14/030911, PCT International Search Report and Written Opinion mailed Aug. 22, 2014, 2014.
U.S. Appl. No. 13/607,612, Office Action mailed Nov. 7, 2014, 2014.
U.S. Appl. No. 13/607,612, Final Office Action mailed Mar. 19, 2015, 2015.
Chinese Patent Application No. 201180050872.3, Second Office Action mailed Jan. 30, 2015, 2011.
Chinese Patent Application No. 201180050872.3, Third Office Action mailed Aug. 4, 2015.
Chinese Patent Application No. 201210330398.6, Fourth Office Action mailed Sep. 17, 2015.
U.S. Appl. No. 13/607,612, Office Action mailed Sep. 3, 2015.
U.S. Appl. No. 14/217,392, Office Action mailed Sep. 16, 2015.
U.S. Appl. No. 13/607,612, Victor Shtrom, Multiband Monopole Antenna Apparatus With Ground Plane Aperture, filed Sep. 7, 2012.
Chinese Patent Application No. 201210330398.6, Third Office Action mailed Jun. 2, 2015.
Siemens, Carrier Lifetime and Forward Resistance in RF PIN Diodes. 1997. [retrieved on Dec. 1, 2013]. Retrieved from the Internet: <URL:http://palgong.kyungpook.ac.kr/~ysyoon/Pdf/appli034.pdf>.
Chinese Patent Application No. 200780023325.X, Second Office Action mailed Oct. 19, 2012.
Chinese Patent Application No. 2007/80020943.9, Second Office Action mailed Aug. 29, 2012.
Taiwan Patent Application No. 096114271, Office Action mailed Dec. 18, 2013.
Taiwan Patent Application No. 096114265, Office Action mailed Jun. 20, 2011.
PCT/US11/052661, PCT Preliminary Report on Patentability mailed Mar. 26, 2013.
PCT/US07/009276, PCT International Search Report and Written Opinion mailed Aug. 11, 2008.
PCT/US13/058713, PCT International Search Report and Written Opinon mailed Dec. 13, 2013.
U.S. Appl. No. 12/545,758, Final Office Action mailed Sep. 10, 2013.
U.S. Appl. No. 13/681,421, Office Action mailed Dec. 3, 2013.

* cited by examiner

ANTENNA WITH DUAL POLARIZATION AND MOUNTABLE ANTENNA ELEMENTS

BACKGROUND OF THE INVENTION

1. Field of the Invention

The present invention generally relates to wireless communications. More specifically, the present invention relates to dual polarization antenna antennas with mountable antenna elements.

2. Description of the Related Art

In wireless communications systems, there is an ever-increasing demand for higher data throughput and reduced interference that can disrupt data communications. A wireless link in an Institute of Electrical and Electronic Engineers (IEEE) 802.11 network may be susceptible to interference from other access points and stations, other radio transmitting devices, and changes or disturbances in the wireless link environment between an access point and remote receiving node. The interference may degrade the wireless link thereby forcing communication at a lower data rate. The interference may, in some instances, be sufficiently strong as to disrupt the wireless link altogether.

FIG. 1 is a block diagram of a wireless device 100 in communication with one or more remote devices and as is generally known in the art. While not shown, the wireless device 100 of FIG. 1 includes antenna elements and a radio frequency (RF) transmitter and/or a receiver, which may operate using the 802.11 protocol. The wireless device 100 of FIG. 1 may be encompassed in a set-top box, a laptop computer, a television, a Personal Computer Memory Card International Association (PCMCIA) card, a remote control, a mobile telephone or smart phone, a handheld gaming device, a remote terminal, or other mobile device.

In one particular example, the wireless device 100 may be a handheld device that receives input through an input mechanism configured to be used by a user. The wireless device 100 may process the input and generate a corresponding RF signal, as may be appropriate. The generated RF signal may then be transmitted to one or more receiving nodes 110-140 via wireless links. Nodes 120-140 may receive data, transmit data, or transmit and receive data (i.e., a transceiver).

Wireless device 100 may also be an access point for communicating with one or more remote receiving nodes over a wireless link as might occur in an 802.11 wireless network. The wireless device 100 may receive data as a part of a data signal from a router connected to the Internet (not shown) or a wired network. The wireless device 100 may then convert and wirelessly transmit the data to one or more remote receiving nodes (e.g., receiving nodes 110-140). The wireless device 100 may also receive a wireless transmission of data from one or more of nodes 110-140, convert the received data, and allow for transmission of that converted data over the Internet via the aforementioned router or some other wired device. The wireless device 100 may also form a part of a wireless local area network (LAN) that allows for communications among two or more of nodes 110-140.

For example, node 110 may be a mobile device with WiFi capability. Node 110 (mobile device) may communicate with node 120, which may be a laptop computer including a WiFi card or wireless chipset. Communications by and between node 110 and node 120 may be routed through the wireless device 100, which creates the wireless LAN environment through the emission of RF and 802.11 compliant signals.

Efficient manufacturing of wireless device 100 is important to provide a competitive product in the market place. Manufacture of a wireless device 100 typically includes construction of one or more circuit boards and one or more antenna elements. The antenna elements can be built into the circuit board or manually mounted to the wireless device. When mounted manually, the antenna elements are attached to the surface of the circuit board and typically soldered although those elements may be attached by other means.

When surface-mounted antenna elements are used in a wireless device, a ground layer of a circuit board within the device is coupled to the antenna elements. Coupling the surface-mounted antenna elements to a ground layer with a large area is required for proper operation of the antenna elements. Dipole antenna elements that are built into a circuit board do not operate very well when positioned close proximity to a ground layer. Hence, when a large ground layer is used to accommodate surface-mounted antenna elements in a wireless device, the presence of the ground layer affects the performance of any dipole antenna elements embedded within the circuit board and usually precludes their use within such a device. A smaller ground layer may result in better performance of embedded dipole antennas but would reduce the efficiency of a surface mounted antenna element. Because of this tradeoff, wireless devices with both surface-mount antenna elements and embedded dipole antenna elements do not provide efficient dual polarization operation.

SUMMARY OF THE PRESENTLY CLAIMED INVENTION

In a claimed embodiment, a wireless device for transmitting a radiation signal may include a circuit board, an antenna array and a radio modulator/demodulator. The circuit board may receive a mountable antenna element for radiating at a first frequency. The antenna array may be coupled to the circuit board. The radio modulator/demodulator may provide a radio frequency (RF) signal to the first mountable antenna and the antenna array.

In another claimed embodiment, a circuit board for transmitting a radiation signal may include a coupling element, a coupling element, a stub, and a radio modulator/demodulator. The coupling element may couple to a mountable antenna element. The stub may be positioned proximate to the antenna array and generate an impedance in the antenna array. The radio modulator/demodulator may provide a RF signal to the first mountable antenna and the antenna array.

In another claimed embodiment, wireless device for transmitting a radiation signal may include communication circuitry, a plurality of antenna elements, a mountable antenna coupling element, and a switching network. The communication circuitry is located within the circuit board and generates a RF signal. The plurality of antenna elements are arranged proximate the edges of the circuit board. Each antenna element may form a radiation pattern when coupled to the communication circuitry and receives a generated impedance. The mountable antenna coupling element is configured on the circuit board and couples a mountable antenna element to the circuit board. The switching network selectively couples one or more of the plurality of antenna elements and the mountable antenna coupling element to the communication circuitry.

DETAILED DESCRIPTION

Embodiments of the present invention allow for the use of a wireless device having a mountable antenna element and an antenna array that operate simultaneously and efficiently on a circuit board within a wireless device. The mountable antenna element may be coupled to a ground layer of the circuit board. The antenna array may include dipole antennas incorporated within the circuit board and positioned within a close proximity to the ground layer. One or more stubs may be implemented on the circuit board near the dipole antenna array. Each antenna stub may create an impedance in the dipole elements which enable the elements to operate efficiently while positioned in close proximity to the circuit board ground layer.

A stub may be coupled to or constructed as an extension of a circuit board ground layer. The stub may extend alongside a dipole antenna element or ground portion and generate a high impedance at a point along the dipole antenna element. The high impedance point enables the antenna dipole to operate without any adverse radiation effects caused from the ground plane. Without the stub, the ground plane would terminate the radiation field of the antenna element in close proximity to the ground plane. The stub enables the antenna element to radiate as if the ground plane were not present or "invisible" to the energy radiated from the antenna element.

The mountable antenna element may be constructed as a single element or object from a single piece of material, can be configured to transmit and receive RF signals, achieve optimized impedance values, and operate in a concurrent dual-band system. The mountable antenna element may have one or more legs, an RF signal feed, and one or more impedance matching elements. The legs and RF signal feed can be coupled to a circuit board. The mountable antenna can also include one or more antenna stubs that enable it for use in concurrent dual band operation with the wireless device.

A reflector may also be mounted to a circuit board having a mountable antenna element. The reflector can reflect radiation emitted by the antenna element. The reflector can be constructed as an element or object from a single piece of material and mounted to the circuit board in a position appropriate for reflecting radiation emitted from the antenna element.

Figure 1:
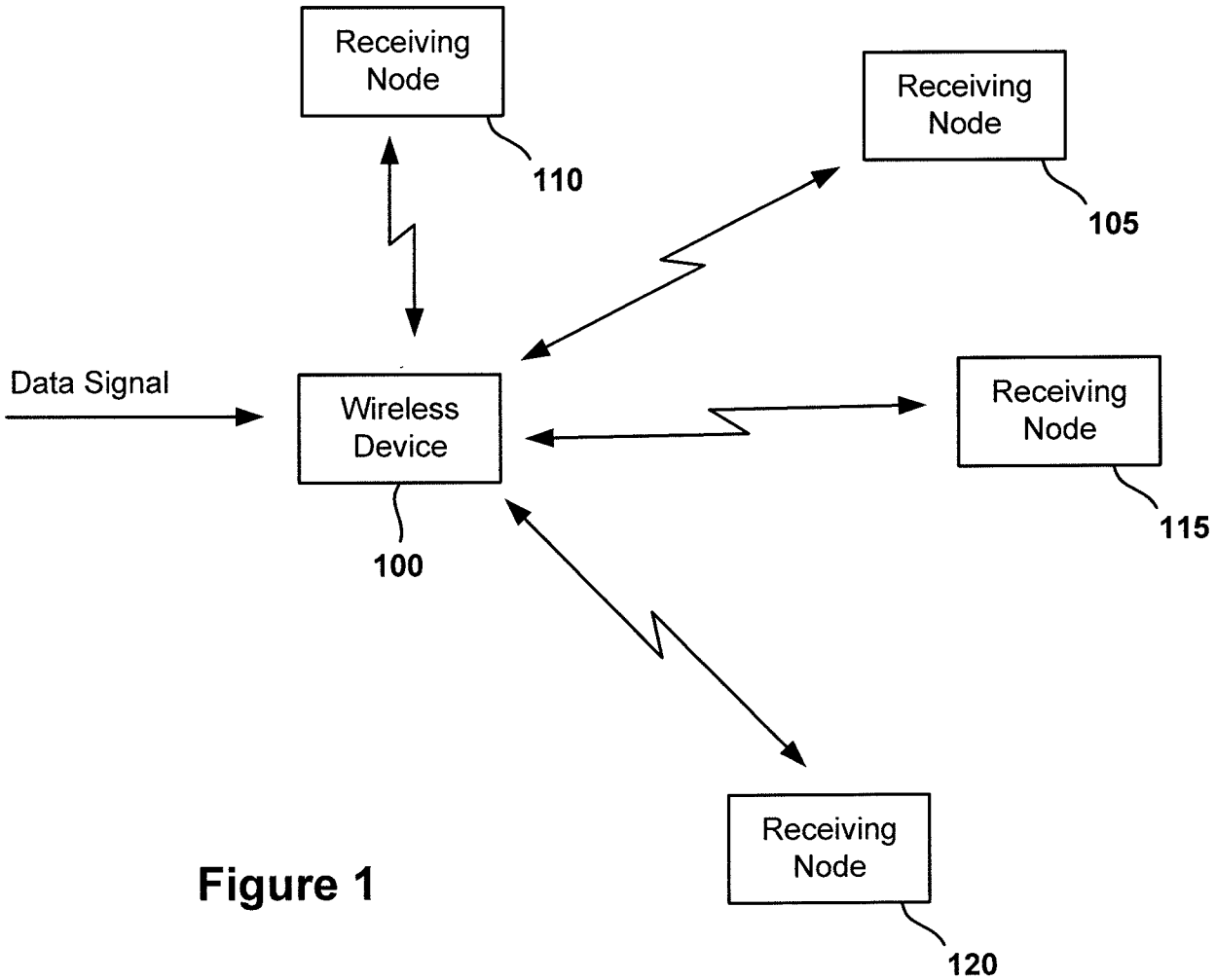
FIG. 1 is a block diagram of a wireless device in communication with one or more remote devices.
Figure 2:
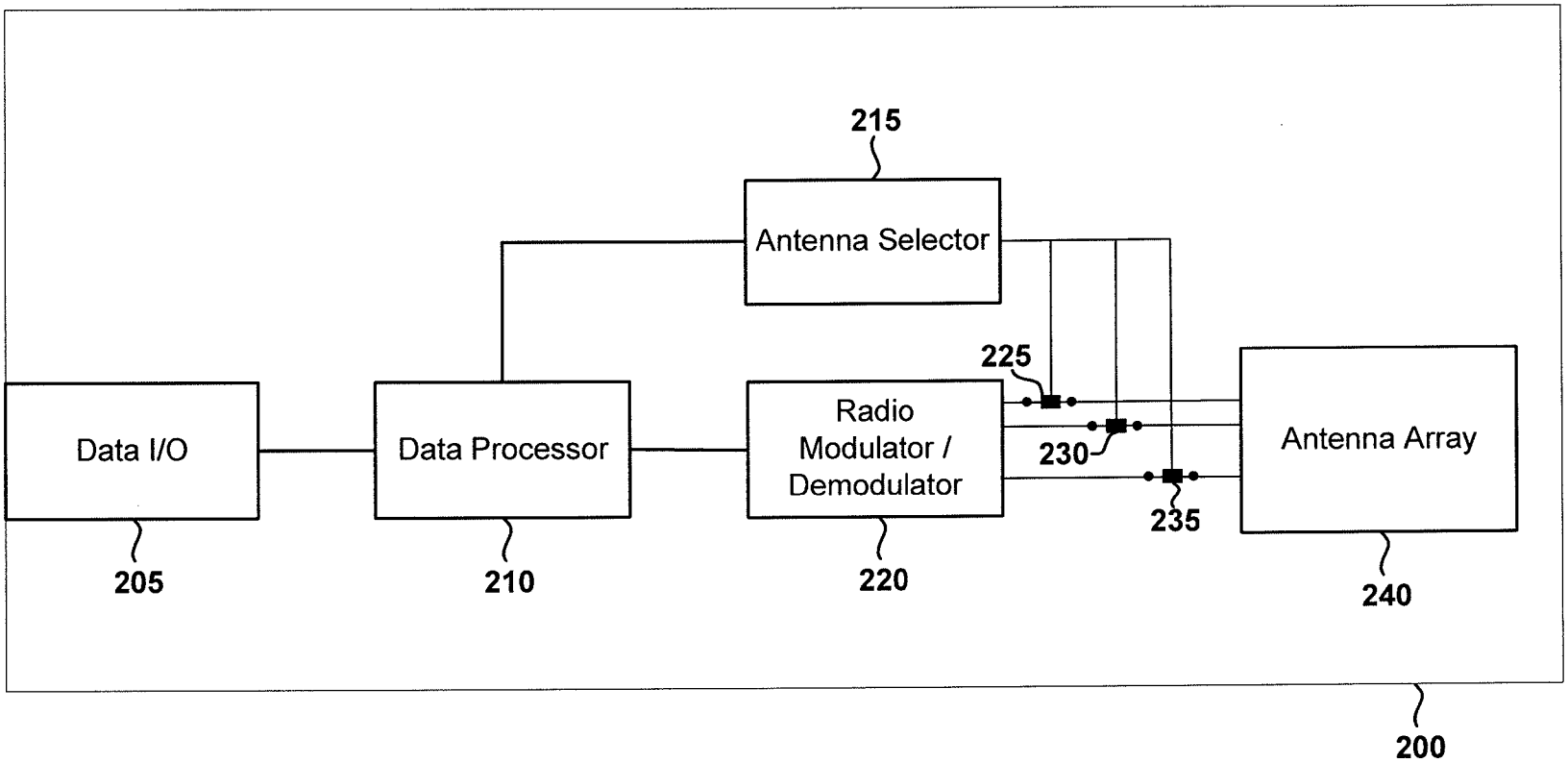
FIG. 2 is a block diagram of a wireless device.

FIG. 2 is a block diagram of a wireless device 200. The wireless device 200 of FIG. 2 can be used in a fashion similar to that of wireless device 100 as shown in and described with respect to FIG. 1. The components of wireless device 200 can be implemented on one or more circuit boards. The wireless device 200 of FIG. 2 includes a data input/output (I/O) module 205, a data processor 210, radio modulator/demodulator 220, an antenna selector 215, diode switches 225, 230, 235, and antenna array 240.

Wireless device may include communication circuitry to generate and direct an RF signal to antenna array 240. The data I/O module 205 of FIG. 2 receives a data signal from an external source such as a router. The data I/O module 205 provides the signal to wireless device circuitry for wireless transmission to a remote device (e.g., nodes 110-140 of FIG. 1). The wired data signal can be processed by data processor 210 and radio modulator/demodulator 220. The processed and modulated signal may then be transmitted via one or more antenna elements within antenna array 240 as described in further detail below. The data I/O module 205 may be any combination of hardware or software operating in conjunction with hardware. Communication circuitry may include any of the data processor, radio modulator/demodulator, and other components.

The antenna selector 215 of FIG. 2 can act as a switching network to select one or more antenna elements within antenna array 240 to radiate the processed and modulated signal. Antenna selector 215 is connected to control one or more of diode switches 225, 230, or 235 to direct the processed data signal to one or more antenna elements within antenna array 240. The antenna elements may include elements comprising part of a dipole antenna and mountable antenna elements. The number of diode switches controlled by antenna selector 215 can be smaller or greater than the three diode switches illustrated in FIG. 2. For example, the number of diode switches controlled can correspond to the number of antenna elements and/or reflectors/directors in the antenna array 240. Antenna selector 215 may also select one or more reflectors/directors for reflecting the signal in a desired direction. Processing of a data signal and feeding the processed signal to one or more selected antenna elements is described in detail in U.S. Pat. No. 7,193,562, entitled "Circuit Board Having a Peripheral Antenna Apparatus with Selectable Antenna Elements," the disclosure of which is incorporated by reference.

Antenna array 240 can include an antenna element array, a mountable antenna element and reflectors. The antenna element array can include a horizontal antenna array with two or more antenna elements. The antenna elements can be configured to operate at frequencies of 2.4 GHZ and 5.0 GHz. Antenna array 240 can also include a reflector/controller array. Each mountable antenna may be configured to radiate at a particular frequency, such as 2.4 GHz or 5.0 GHz. The mountable antenna element and reflectors can be located at various locales on the circuit board of a wireless device, including at about the center of the board.

Figure 3:
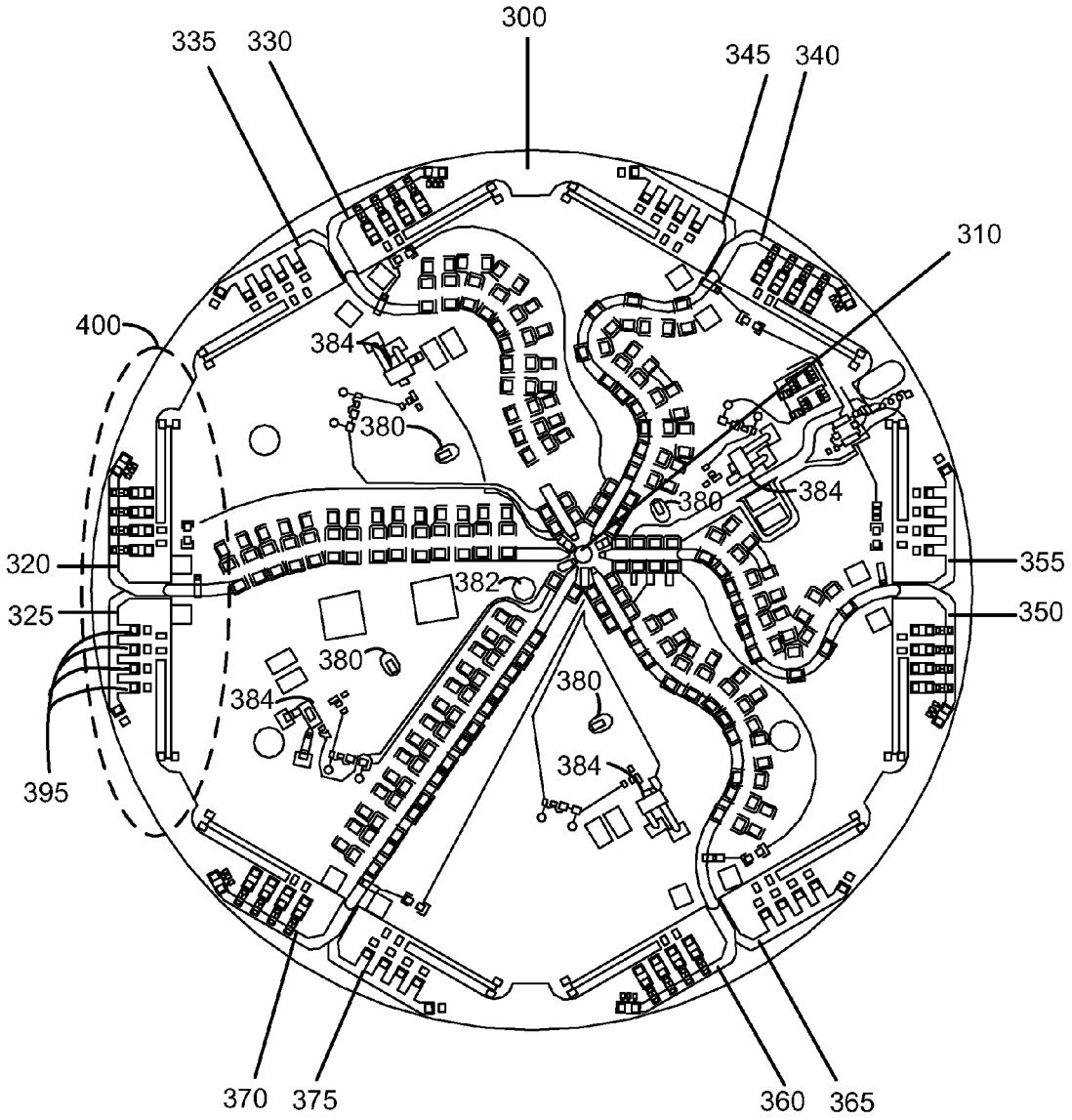
FIG. 3 illustrates a circuit board footprint that includes a horizontally polarized antenna array and is configured to receive a surface-mounted antenna element.

FIG. 3 illustrates a circuit board footprint that includes a horizontally polarized antenna array and is configured to receive a surface-mounted antenna element. The circuit board has a circular configuration which includes a substrate having a first side and a second side that can be substantially parallel to the first side. The substrate may comprise, for example, a PCB such as FR4, Rogers 4003 or some other dielectric material.

The antenna array incorporated into the circuit board includes radio frequency feed port 310 selectively coupled to antenna elements 320, 330, 340, 350, 360, and 370. Although six antenna elements are depicted in FIG. 3, more or fewer antenna elements can be implemented. Further, while antenna elements 320-370 of FIG. 3 are oriented substantially to the edges of a circular shaped substrate, other shapes and layouts, both symmetrical and non-symmetrical, can be implemented.

Also within the circuit board, depicted as dashed lines in FIG. 3, the antenna array 300 includes a ground component including ground portions 325, 335, 345, 355, 365, and 375. Each ground portion may form a dipole with a corresponding antenna element. For example, a ground portion 325 of the ground component can be configured to form a modified dipole in conjunction with the antenna element 320. Each of the ground components can be selectively coupled to a ground plane in the substrate (not shown). As shown in FIG. 3, a dipole is completed for each of the antenna elements 320-370 by respective conductive traces 325-375 extending in mutually opposite directions. The resultant modified dipole provides a horizontally polarized directional radiation pattern (i.e., substantially in the plane of the circuit board).

Each antenna element 320, 330, 340, 350, 360, and 370 and corresponding ground portion may be about the same length. As shown in FIG. 3, when a radio frequency feed port 310 is located at a position other than the center of the circuit board, one or more antenna elements may extend away from the feed port 310 in a non-linear direction (e.g., antenna elements 330 and 360 have slightly curved paths within circuit board 300, antenna elements 340 and 350 have a path with more curves than that of elements 330 and 360). The different paths of the antenna elements 320, 330, 340, 350, 360, and 370 are implemented to configure the antenna elements at about the same length.

To minimize or reduce the size of the antenna array, each of the modified dipoles (e.g., the antenna element 320 and the portion 325 of the ground component) may incorporate one or more loading structures 390. For clarity of illustration, only the loading structures 390 for the modified dipole formed from antenna element 320 and portion 325 are numbered in FIG. 3. By configuring loading structure 390 to slow down electrons and change the resonance of each modified dipole, the modified dipole becomes electrically shorter. In other words, at a given operating frequency, providing the loading structures 390 reduces the dimension of the modified dipole. Providing the loading structures 390 for one or more of the modified dipoles of the antenna array 300 minimizes the size of the loading structure 390.

Antenna selector 215 of FIG. 2 can be used to couple the radio frequency feed port 310 to one or more of the antenna elements within the antenna element array on circuit board 300. The antenna selector 215 may include an RF switching devices, such as diode switches 225, 230, 235 of FIG. 2, a GaAs FET, or other RF switching devices to select one or more antenna elements of antenna element array. For the exemplary horizontal antenna array illustrated in FIG. 3, the antenna element selector can include six PIN diodes, each PIN diode connecting one of the antenna elements 320-370 (FIG. 3) to the radio frequency feed port 310. In this embodiment, the PIN diode comprises a single-pole single-throw switch to switch each antenna element either on or off (i.e., couple or decouple each of the antenna elements 320-370 to the radio frequency feed port 310).

A series of control signals can be used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 310 and the PIN diodes of the antenna element selector are on the side of the substrate with the antenna elements 320-370, however, other embodiments separate the radio frequency feed port 310, the antenna element selector, and the antenna elements 320-370.

One or more light emitting diodes (LED) (not shown) can be coupled to the antenna element selector. The LEDs function as a visual indicator of which of the antenna elements 320-370 is on or off. In one embodiment, an LED is placed in circuit with the PIN diode so that the LED is lit when the corresponding antenna element is selected.

Figure 6:
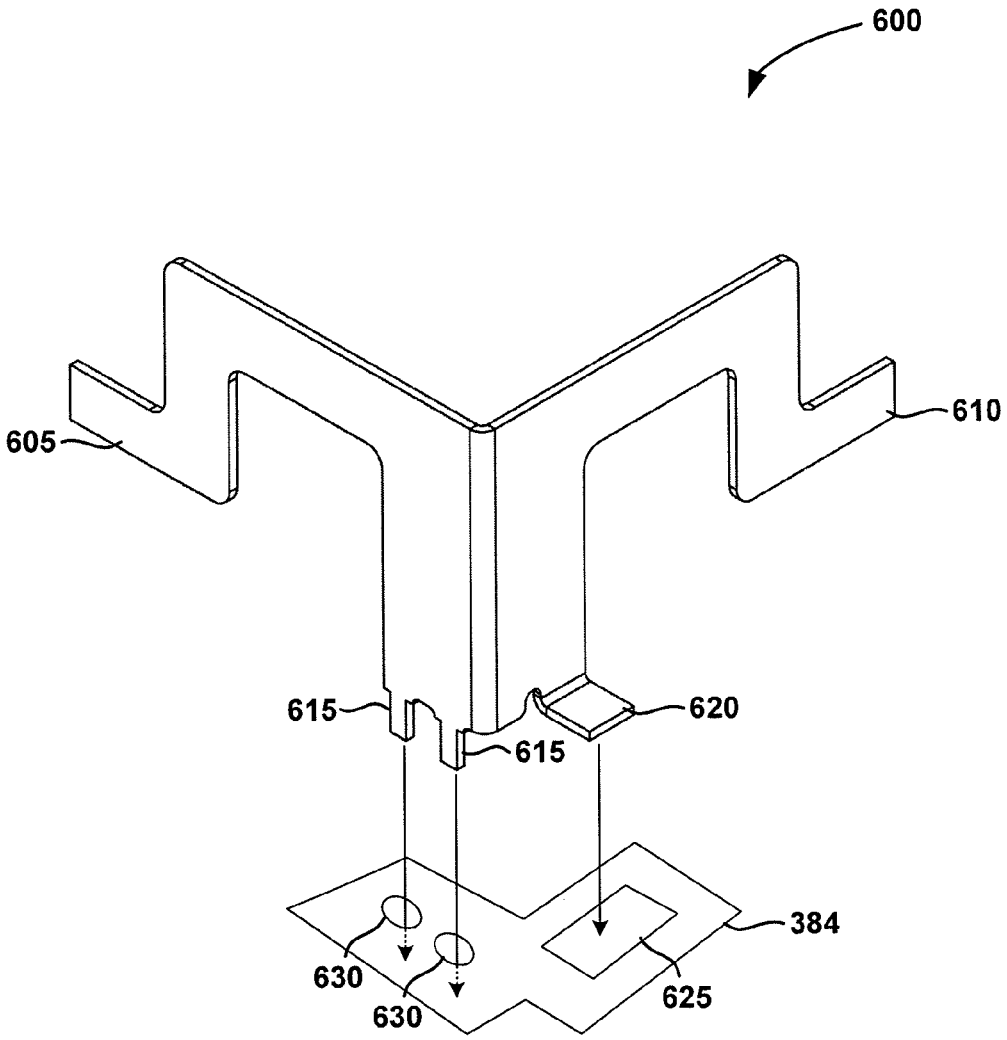
FIG. 6 is perspective view of a mountable reflector.
Figure 8:
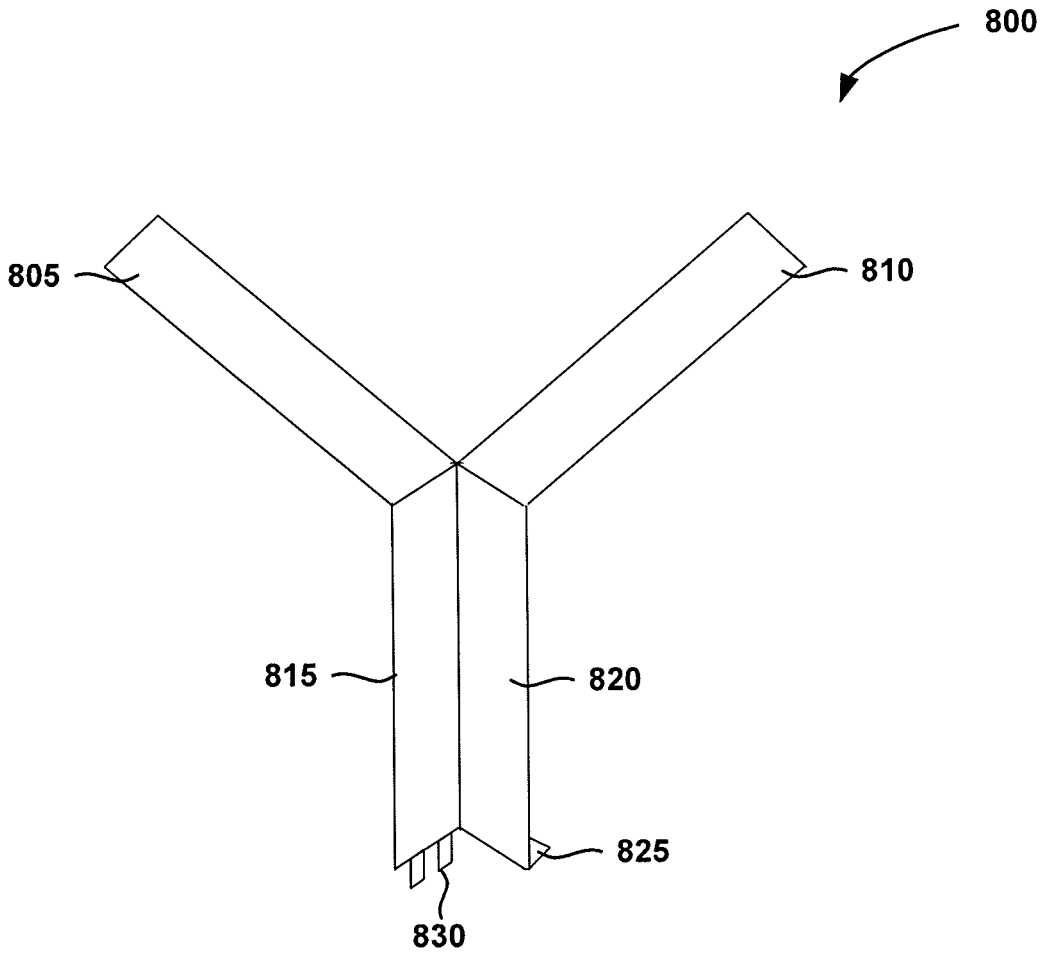
FIG. 8 is perspective view of an alternative embodiment of a mountable reflector.

A mountable antenna element can be coupled to the circuit board 300 using coupling elements such as for example coupling pads 380 and 382. Reflectors for reflecting or directing the radiation of a mounted antenna element can be coupled to the circuit board at coupling pads 384. A coupling pad is a pad connected to circuit board circuitry (for example a switch or ground) and to which the antenna element can be connected, for example via solder. The antenna element can include a coupling plate having a surface that, when mounted to the circuit board, is roughly parallel and in contact with the circuit board coupling pads 380 and 382. Reflectors may include a coupling plate for coupling the reflector to coupling pads 384. A coupling plate is an antenna element surface (e.g., a surface at the end of an antenna element leg) that may be used to connect the antenna element to a coupling pad. Antenna elements having a coupling plate (e.g., coupling plate 670) are illustrated in FIGS. 6 and 8. The antenna element coupling plate can be coupled (e.g., by solder) to the couple pads 380 and 382 such that the antenna element is mechanically and electronically coupled to coupling pads 380 and 382.

Coupling pads 380 and 384 can be connected to ground and coupling pad 382 can be connected to a radio modulator/demodulator 220 through a diode switch (e.g., diode switch 230). Coupling pads 380, 382 and 384 can include one or more coupling pad holes for receiving an antenna element pin to help the secure antenna element to the circuit board. Mountable antenna elements, reflectors, and circuit boards circuit boards configured to receive the elements and reflectors are described in more detail in U.S. patent application Ser. No. 12/545,758, filed on Aug. 21, 2009, and titled "Mountable Antenna Elements for Dual Band Antenna," the disclosure of which is incorporated herein by reference.

The antenna components (e.g., the antenna elements 320-370, the ground components 325-375, a mountable antenna element, and any reflector/directors for the antenna elements and mountable antenna element) are formed from RF conductive material. For example, the antenna elements 320-370 and the ground components 325-375 can be formed from metal or other RF conducting material. Rather than being provided on opposing sides of the substrate as shown in FIG. 3, each antenna element 320-370 is coplanar with the ground components 325-375.

The antenna components can be conformally mounted to a housing. The antenna element selector comprises a separate structure (not shown) from the antenna elements 320-370 in such an embodiment. The antenna element selector can be mounted on a relatively small PCB, and the PCB can be electrically coupled to the antenna elements 320-370. In some embodiments, a switch PCB is soldered directly to the antenna elements 320-370.

Antenna elements 320-370 can be selected to produce a radiation pattern that is less directional than the radiation pattern of a single antenna element. For example, selecting all of the antenna elements 320-370 results in a substantially omnidirectional radiation pattern that has less directionality than the directional radiation pattern of a single antenna element. Similarly, selecting two or more antenna elements may result in a substantially omnidirectional radiation pattern. In this fashion, selecting a subset of the antenna elements 320-370, or substantially all of the antenna elements 320-370, may result in a substantially omnidirectional radiation pattern for the antenna array.

Reflector/directors may further be implemented in circuit board 300 to constrain the directional radiation pattern of one or more of the antenna elements 320-370 in azimuth. Other benefits with respect to selectable configurations are disclosed in U.S. patent application Ser. No. 11/041,145 filed Jan. 21, 2005 and entitled "System and Method for a Minimized Antenna Apparatus with Selectable Elements," the disclosure of which is incorporated herein by reference.

Figure 4:
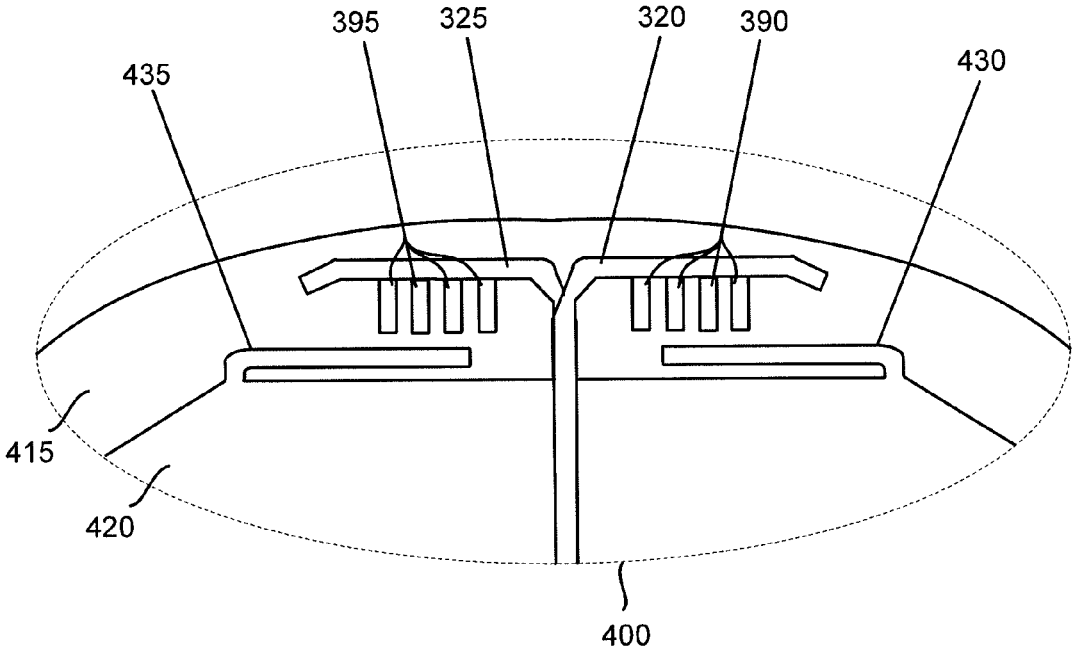
FIG. 4 is a portion of the circular configuration of a dual polarized antenna array.

FIG. 4 illustrates a portion of a circuit board 300 that includes a horizontally polarized antenna array. The portion illustrated in FIG. 4 corresponds to circuit board portion 400 indicated by the dashed line in FIG. 3. FIG. 4 includes circuit board portion 415, ground layer 420, antenna element 320, ground component 325, loading structures 390 and 395, and stubs 430 and 435. Stubs 430 and 435 may be coupled to ground component 325 and extend along loading structures 390 and 395.

The stubs create a high impedance point at a position within an antenna element or ground element. The high impedance point results in no current in the corresponding antenna element or ground element. For example, for ground portion 325, the high impedance point may be generated at a point about half way within the ground portion 325, extruding away from antenna element 320, or at a point on the ground portion 325 between the two middle loading structures. The high impedance point allows the ground plane 420 to be in close proximity to the dipole without affecting the radiation of the dipole.

By creating the high impedance point, the stub allows an antenna element to be positioned in close proximity to ground plane 420 without affecting operation (i.e., radiation) of the antenna element. This overcomes problems associated with ground planes that terminate the radiation field of a dipole when the ground plane is too close to a dipole antenna element and corresponding ground portion. The stub enables a larger ground plane for use in a circuit board with dipoles and mountable antenna elements, which is desirable as the larger ground plane is needed for proper operation of a mountable antenna element.

The length of a stub may be selected based on the design of the circuit in which the stub is implemented. The stub may be positioned a distance of one quarter wavelength from the ground plane, wherein the wavelength may be derived from the dipole antenna element radiating frequency. The length of the stub may be selected based on where in an antenna element or ground element the impedance point should be generated. For a circuit having an antenna array that radiates at 2.4 GHz, the stub may have a length of about 595 mils (thousandths of an inch) and a slot width (the width of the slot between the ground plane 420 and the stub) of about 20 mils. With this configuration, the dipole can be within about 300 mils of the ground plane. The stubs, dipoles and loading structures may include extension units for extending their length. For example, an extension unit may include a zero ohm resistor coupled to the end of a stub, dipole or loading structure during manufacturing or testing of the circuit.

Figure 5:
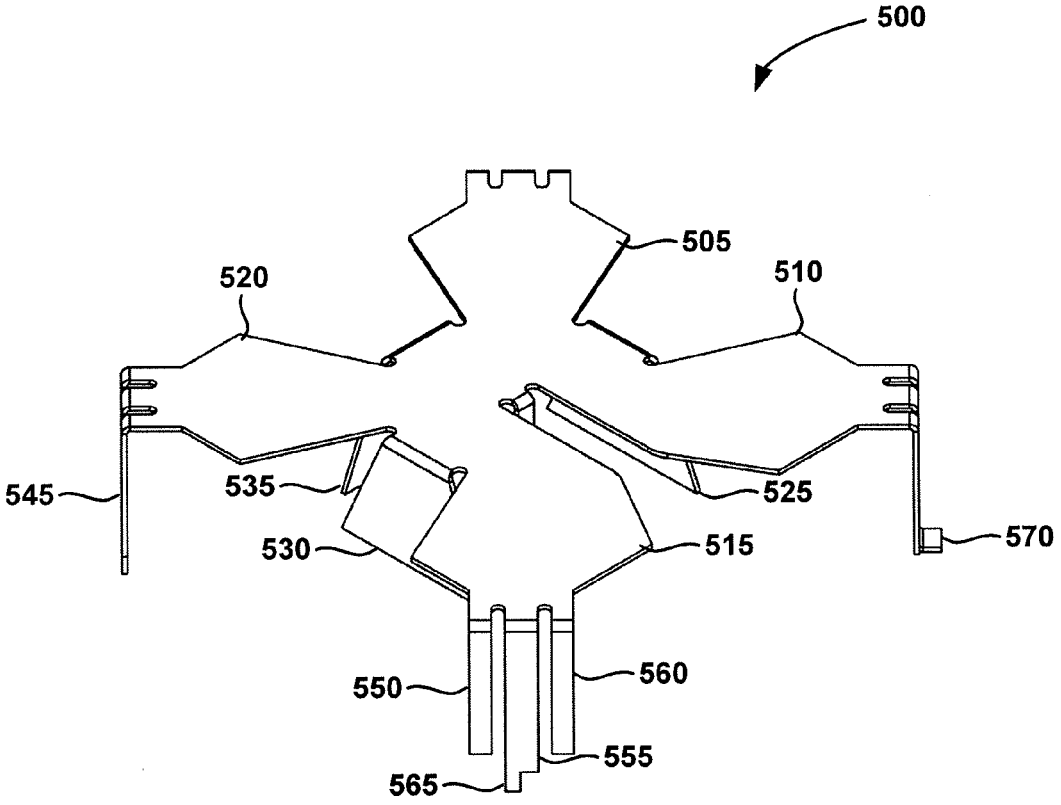
FIG. 5 is a perspective view of a mountable antenna element.

FIG. 5 is a perspective view of a mountable antenna element 500. The mountable antenna element 500 of FIG. 5 can be configured to radiate at a frequency such as 2.4 GHz. Extending horizontally outward from the center of a top surface of the antenna element 500 are top surface portions 505, 510, 515 and 520. Extending downward from each top surface portion is a leg (e.g., 555), and a side member on each side of each leg (e.g., side members 550 and 560). As illustrated in FIG. 5, each set of a leg and two side members extends downward at about a ninety degree angle from the plane formed by the top portions 505-520.

The antenna element legs can be used to couple the antenna element to circuit board 300 (FIG. 3). An antenna element leg can include a coupling plate 570 or a leg pin 565. A coupling plate 570 can be attached through solder to a coupling pad 380 on circuit board 300. An antenna element leg can also be attached to circuit board 300 by a leg pin 565. Leg pin 565 may be inserted into a coupling pad hole in circuit board 300. An antenna element can be positioned on a circuit board by inserting the leg pins in a matching set of coupling pad holes and then soldering each leg (both coupling plate and pins) to their respective coupling pads 380.

When the antenna element coupling plate 570 is connected to circuit board coupling pad 380 and a switch connecting the coupling pad 380 to radio modulator/demodulator 220 is open, no radiation pattern is transmitted or received by the mounted antenna element. When the switch is closed, the mounted antenna element is connected to radio modulator/demodulator 220 and may transmit and receive RF signals. The length of the side members 550 and 560 can be chosen at time of manufacture based on the frequency of the antenna element from which radiation is being received.

Extending downward from near the center of the top surface 505, 510, 515, 520 are impedance matching elements 525, 530 and 535. Impedance matching elements 525, 530, 535 as illustrated in FIG. 5 extend downward from the top surface, such as impedance matching element 530 extending downward between top surface portions 515 and 520 and impedance matching element 535 extending downward between top surface portions 520 and 505.

Impedance matching elements 525 and 535 extend downward towards a ground layer within circuit board 300 and form a capacitance between the impedance matching element and the ground layer. By forming a capacitance with the ground layer of the circuit board 300, the impedance matching elements achieve impedance matching at a desired frequency of the antenna element. To achieve impedance matching, the length of the impedance matching element and the distance between the circuit board ground layer and the closest edge of the downward positioned impedance matching element can be selected based on the operating frequency of the antenna element. For example, when an antenna element 500 is configured to radiate at about 2.4 GHz, each impedance matching element may be about 8 millimeters long and positioned such that the edge closest to the circuit board is about 2-6 millimeters (e.g., about 3.6 millimeters) from a ground layer within the circuit board.

The mountable antenna element may also include a radio frequency (RF) feed element that extends down from the center of the top surface between impedance matching members 425 and 430 and can be coupled to coupling pad 382 on circuit board 300. The RF feed element includes a plate that can be coupled via solder or some other process for creating a connection between the coupling pad 382 and antenna element 400 through which an RF signal can travel.

FIG. 6 is a perspective view of a mountable reflector 600. Reflector 600 includes a first side 605 and a second side 610 disposed at an angle of about ninety degrees from one another. The two sides 605 and 610 meet at a base end and extend separately to a respective outer end. The base end of side 605 includes two mounting pins 615. The mounting pins may be used to position reflector 600 in holes 330 of a mounting pad 384 of circuit board 300. The base end of side 610 includes a coupling plate 620 for coupling the reflector to a mounting pad 384 (e.g., by solder). The pins 615 can also be coupled to mounting pad 384 via solder. Once the pins 615 are inserted into holes 330 and coupling plate 620 is in contact with a mounting pad 384 as illustrated in FIG. 6, the reflector 600 can stand upright over mounting area 320 without additional support.

Reflector 600 can be constructed as an object formed from a single piece of material, such as tin, similar to the construction of antenna element 500. The reflector 600 can be symmetrical except for the pins 615 and the plate 620. Hence, the material for reflector 600 can be built as a flat and approximately "T" shaped unit with a center portion with arms extending out to either side of the center portion. The flat element can then be bent, for example, down the center of the base such that each arm is of approximately equal size and extends from the other arm at a ninety-degree angle.

Figure 7:
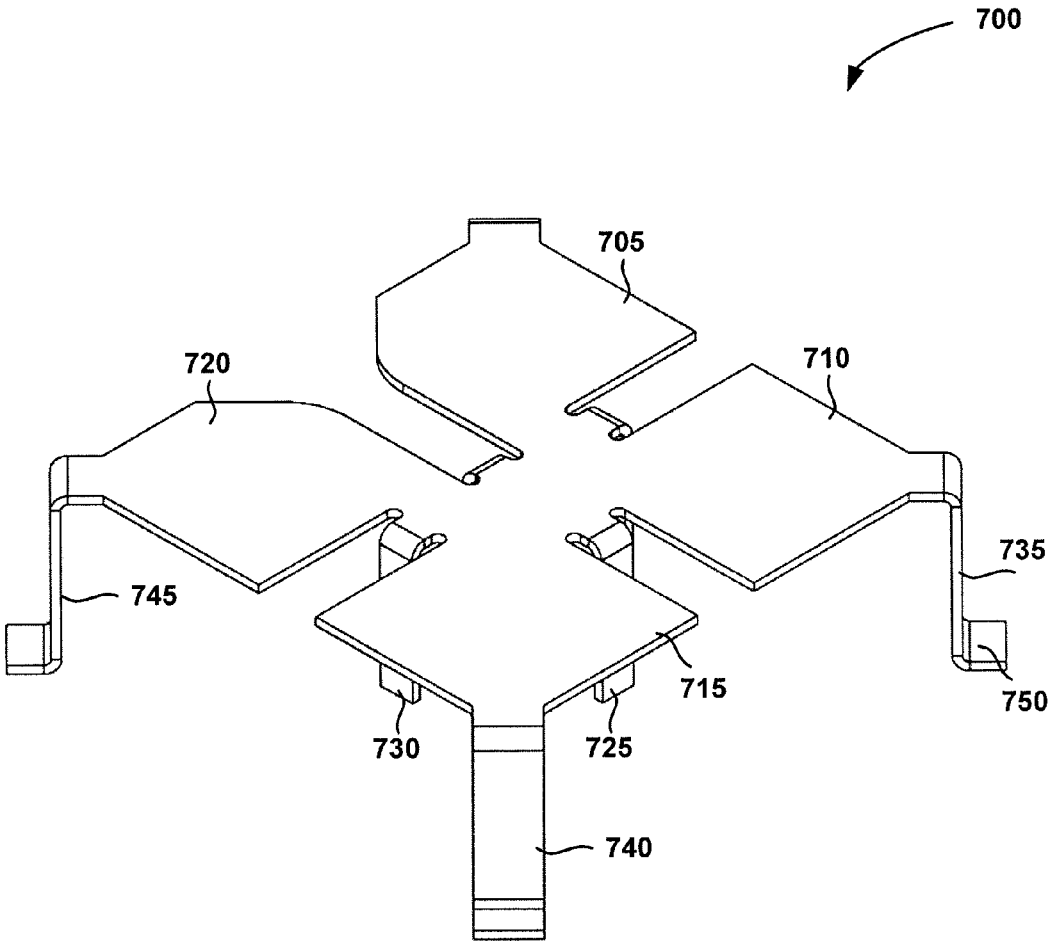
FIG. 7 is a perspective view of an alternative embodiment of a mountable antenna element.

FIG. 7 is a perspective view of an alternative embodiment of a mountable antenna element. The alternative embodiment of mountable antenna element 700 can be configured to radiate with vertical polarization at a frequency of about 5.0 GHz. Extending horizontally outward from the center of a top surface of the antenna element 700 are top surface portions 705, 710, 715, and 720. Extending downward from each top surface portion are legs 735, 740, and 745, such as leg 740 extending from top portion 715. A fourth leg positioned opposite to leg 740 and extending from top portion 705 is not visible in FIG. 7. Each leg can extend downward at about a ninety degree angle from the plane formed by the top surface portions 705-720.

The antenna element legs can be used to couple the antenna element to circuit board 300 (FIG. 3) by attaching the coupling plate, for example through solder, to a coupling pad 380 on circuit board 300. An antenna element leg can also be attached to circuit board 300 by inserting a leg pin on an antenna element leg in corresponding coupling pad holes and soldering each leg (both coupling plate and pins) to their respective coupling pads 380.

Extending downward from near the center of the top surface are impedance matching elements 725 and 730. A third impedance matching element is positioned opposite to impedance matching element 730 but not visible in the view of FIG. 7. The impedance matching elements 725 and 730 can extend between an inner portion of each top portion, such as impedance matching element 730 extending downward between top portions 715 and 720 and impedance matching element 725 extending downward between top portions 710 and 715.

Mountable antenna element 700 may include an RF feed element that extends down towards ground and is positioned opposite to impedance matching element 725 near the center of the top surface of antenna element 700. The RF feed element can be coupled to coupling pad 382 on circuit board 300. The RF feed element can include a coupling plate to be coupled to coupling pad 382 via solder or some other process for creating a connection between the RF source and antenna element 700.

Impedance matching elements 725 and 730 extend downward from the top surface toward a ground layer within circuit board 300 and form a capacitance between the impedance matching element and the ground layer. The impedance matching elements achieve impedance matching at a desired frequency based on the length of the impedance matching element and the distance between the circuit board ground layer and the closest edge of the downward positioned impedance matching element based. For example, when an antenna element 700 is configured to radiate at about 5.0 GHz, each impedance matching element may be about 5 millimeters long and positioned such that the edge closest to the circuit board is between 2-6 millimeters (e.g., about 2.8 millimeters) from a ground layer within the circuit board.

FIG. 8 is a perspective view of an alternative embodiment of a mountable reflector 800. The mountable reflector 800 can be used to reflect a signal having a frequency of 5.0 GHz when connected to ground, for example a signal radiated by antenna element 700. Reflector 800 includes two sides 815 and 820 which form a base portion and side extensions 805 and 810, respectively. The side extensions are configured to extend about ninety degrees from each other. Base 815 includes two mounting pins 830. The mounting pins may be used to position reflector 800, for example via solder, in holes of a mounting pad 384 of a circuit board 300.

Base 820 includes a mounting plate 825. Mounting plate 825 can be used to couple reflector 800 to circuit board 300 via solder. In addition to mounting plate 825, pins 815 can also be soldered to mounting pad 384. Once the pins 830 are inserted into holes within a coupling pad and coupling plate 825 is in contact with the surface of the mounting pad, the reflector 800 can stand upright without additional support, making installation of the reflectors easier than typical reflectors which do not have mounting pins 830 and a mounting plate 825.

Reflector 800 can be constructed as an object from a single piece of material, such as a piece of tin. The reflector 800 can be symmetrical except for the pins 830 and the plate 825. Hence, the material for reflector 800 can be built as a flat and approximately "T" shaped unit. The flat element can then be bent down the center such that each arm is of approximately equal size and extends from the other arm at a ninety-degree angle.

The present technology may be used with a variety of circuits, circuit boards, and antenna technology, such as the technology described in U.S. patent application Ser. No. 12/212,855 filed Sep. 18, 2008, which is a continuation of U.S. patent application Ser. No. 11/938,240 filed Nov. 9, 2007 and now U.S. Pat. No. 7,646,343, which claims the priority benefit of U.S. provisional application 60/865,148 filed Nov. 9, 2006; U.S. patent application Ser. No. 11/938,240 which is also a continuation-in-part of U.S. patent application Ser. No. 11/413,461 filed Apr. 28, 200, which claims the priority benefit of U.S. provisional application No. 60/694,101 filed Jun. 24, 2005, and the disclosure of each of the aforementioned applications is incorporated herein by reference.

Though a finite number of mountable antenna elements are described herein, other variations of single piece construction mountable antenna elements are considered within the scope of the present technology. For example, an antenna element 400 generally has an outline of a generally square shape with extruding legs and side members as illustrated in FIG. 4. Other shapes can be used to form a single piece antenna element, including a triangle and a circle, with one or more legs and impedance matching elements, and optionally one or more side members to enable efficient operation with other antenna elements. Additionally, other shapes and configuration may be used to implement one or more reflectors with each antenna element.

The embodiments disclosed herein are illustrative. Various modifications or adaptations of the structures and methods described herein may become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A wireless device for transmitting an 802.11 compliant radiation signal, comprising:

a circuit board;

a mountable antenna element mounted to a surface of the circuit-board;

a ground layer disposed within the circuit board and coupled to the mountable antenna element;

a stub coupled to the ground layer;

an antenna array including a plurality of antenna elements embedded in the circuit board proximate to the ground layer, wherein an impedance generated by the stub associated near the plurality of embedded antenna elements is sufficient to counteract any terminating effect of the proximate ground layer; and a radio modulator/demodulator that provides an 802.11 radio frequency (RF) signal to the mountable antenna element and one or more embedded antenna elements of the plurality of embedded antenna elements, wherein the mountable antenna element and the one or more embedded antenna elements operate concurrently in both the 2.4 Ghz and 5.0 Ghz bands.

2. The wireless device of claim 1, wherein the stub is positioned proximate to the plurality of embedded antenna elements.

3. The wireless device of claim 2, wherein the stub is implemented as a portion of the ground layer.

4. The wireless device of claim 2, wherein the stub has a length of about one quarter of the wavelength of the radiation frequency of the plurality of embedded antenna elements.

5. The wireless device of claim 1, wherein the circuit board is coupled to the mountable antenna element through a plurality of legs and an RF feed of the mountable antenna element.

6. The wireless device of claim 1, wherein the mountable antenna element generates a radiation pattern having a polarization perpendicular to the plane of the circuit board.

7. The wireless device of claim 1, wherein the one or more embedded antenna elements generate a radiation pattern having a polarization in the plane of the circuit board.

8. The wireless device of claim 1, further comprising a reflector disposed proximate the mountable antenna element that reflects a radiation pattern of the mountable antenna element.

9. The wireless device of claim 8, wherein the reflector is coupled to the circuit board.

10. The wireless device of claim 9, wherein the reflector is coupled to the circuit board through a mounting plate.

11. The wireless device of claim 10, wherein the reflector is flat and approximately "T" shaped.

12. The wireless device of claim 1, wherein the circuit board provides the mountable antenna element and the one or more embedded antenna elements with the RF signal for simultaneous radiation.

13. A wireless device for transmitting an 802.11 compliant radiation signal, comprising:

communication circuitry located within a circuit board, the communication circuitry generating an 802.11 radio frequency (RF) signal;

a mountable antenna element;

a ground layer disposed within the circuit board and coupled to the mountable antenna element;

a stub coupled to the ground layer an antenna array including a plurality of embedded antenna elements, wherein the plurality of embedded antenna elements are disposed proximate to the edges of the circuit board and proximate to the ground layer, wherein an impedance generated by the stub associated near each of the plurality of embedded antenna elements is sufficient to counteract any terminating effect of the proximate ground layer and forming a radiation pattern when coupled to the communication circuitry; and a switching network that selectively couples one or more embedded antenna elements of the plurality of embedded antenna elements and the mountable antenna element to the communication circuitry, wherein the mountable antenna element and the one or more embedded antenna elements operate concurrently in the 2.4 GHz and 5.0 GHz bands.

14. The wireless device of claim 13, wherein the stub is positioned proximate to the plurality of embedded antenna elements.

15. The wireless device of claim 14, wherein the stub is implemented as a portion of the ground layer.

16. The wireless device of claim 14, wherein the stub has a length of about one quarter of the wavelength of the generated RF signal.

17. The wireless device of claim 13, further comprising a reflector disposed proximate to the mountable antenna element to reflect a radiation pattern of the mountable antenna element.

18. The wireless device of claim 17, wherein the reflector is coupled to the circuit board.

19. The wireless device of claim 18, wherein the reflector is coupled to the circuit board through a mounting plate.

20. The wireless device of claim 19, wherein the reflector is flat and approximately "T" shaped.

* * * * *